US010264638B2

(12) United States Patent
Cash et al.

(10) Patent No.: US 10,264,638 B2
(45) Date of Patent: Apr. 16, 2019

(54) CIRCUITS AND METHODS FOR CONTROLLING SOLID STATE LIGHTING

(71) Applicant: Cree, Inc., Durham, NC (US)

(72) Inventors: Mark Cash, Raleigh, NC (US); Shawn Hill, Raleigh, NC (US)

(73) Assignee: Cree, Inc., Durham, NC (US)

( * ) Notice: Subject to any disclaimer, the term of this patent is extended or adjusted under 35 U.S.C. 154(b) by 0 days.

(21) Appl. No.: 14/230,651

(22) Filed: Mar. 31, 2014

(65) Prior Publication Data

US 2014/0210364 A1 Jul. 31, 2014

Related U.S. Application Data

(63) Continuation-in-part of application No. 14/227,626, filed on Mar. 27, 2014, and a continuation-in-part of application No. 13/742,008, filed on Jan. 15, 2013.
(Continued)

(51) Int. Cl.
*H05B 33/00* (2006.01)
*H05B 33/08* (2006.01)

(52) U.S. Cl.
CPC ..... *H05B 33/083* (2013.01); *H05B 33/0866* (2013.01)

(58) Field of Classification Search
CPC ..... H05B 33/083; H05B 33/0824; H05B 33/0845; H05B 33/0842; H05B 33/0857; H05B 37/02; G09G 3/3406
(Continued)

(56) References Cited

U.S. PATENT DOCUMENTS 4,798,983 A 1/1989 Mori
4,839,535 A 6/1989 Miller
(Continued)

FOREIGN PATENT DOCUMENTS

JP H06224720 8/1994
JP 3412702 6/2003
(Continued)

OTHER PUBLICATIONS

E. Fred Schurbert, Light-Emitting Diodes, Second Edition, Cambridge Universtity Press.*
(Continued)

*Primary Examiner* — Monica C King
(74) *Attorney, Agent, or Firm* — Myers Bigel, P.A.

(57) ABSTRACT

A solid state lighting apparatus can include a plurality of light-emitting devices (LEDs) that are electrically coupled together in at least one string. The apparatus can further include a first LED segment that is configured to emit a first chromaticity light coupled across a first bypass circuit, a second LED segment that is configured to emit a second chromaticity light coupled across a second bypass circuit, and at least one additional LED segment that is configured to emit an additional chromaticity light coupled across a respective at least one additional bypass circuit. A control circuit can be configured to modulate the at least one additional bypass circuit, to cause the lighting apparatus to emit an additional v' shift in a chromaticity value of light emitted by the string to vary substantially in conformance with a Planckian locus in response to a dimming input to the control circuit.

23 Claims, 14 Drawing Sheets

Related U.S. Application Data

(60) Provisional application No. 61/808,553, filed on Apr. 4, 2013, provisional application No. 61/808,519, filed on Apr. 4, 2013.

(58) Field of Classification Search
USPC ..... 315/186, 185 R
See application file for complete search history.

(56) References Cited

U.S. PATENT DOCUMENTS 5,334,916 A 8/1994 Noguchi
5,397,938 A 3/1995 Wihelm et al.
5,847,340 A 12/1998 Godesa
5,929,568 A 7/1999 Eggers
6,385,226 B2 5/2002 McMinn et al.
6,441,558 B1 8/2002 Muthu et al.
6,498,440 B2 12/2002 Stam et al.
6,617,795 B2 9/2003 Bruning
6,636,003 B2 10/2003 Rahm et al.
6,697,130 B2 2/2004 Weindorf et al.
6,753,661 B2 6/2004 Muthu et al.
6,788,011 B2 9/2004 Mueller et al.
6,864,641 B2 3/2005 Dygert
6,885,035 B2 4/2005 Bhat et al.
6,998,594 B2 2/2006 Gaines et al.
7,038,399 B2 5/2006 Lys et al.
7,067,995 B2 6/2006 Gunter et al.
7,091,874 B2 8/2006 Smithson
7,213,940 B1 5/2007 Van de Ven et al.
7,233,831 B2 6/2007 Blackwell
7,238,898 B1 7/2007 Czarnecki
7,245,089 B2 7/2007 Yang
7,352,138 B2 4/2008 Lys et al.
7,358,679 B2 4/2008 Lys et al.
7,432,668 B2 10/2008 Zwanenburg et al.
7,515,128 B2 4/2009 Dowling
7,772,757 B2 8/2010 Kane et al.
7,812,553 B2 10/2010 Kang et al.
7,821,194 B2 10/2010 Negley et al.
7,967,652 B2 6/2011 Emerson
2001/0032985 A1 10/2001 Bhat et al.
2002/0047624 A1 4/2002 Stam et al.
2004/0105261 A1 6/2004 Ducharme et al.
2005/0007164 A1 1/2005 Callahan, Jr.
2005/0127381 A1 6/2005 Vitta et al.
2005/0162100 A1 7/2005 Romano et al.
2005/0280376 A1 12/2005 Hamidian et al.
2006/0152172 A9 7/2006 Mueller
2006/0226956 A1 10/2006 Young et al.
2007/0040512 A1 2/2007 Jungwirth et al.
2007/0115228 A1 5/2007 Roberts et al.
2007/0115662 A1 5/2007 Roberts et al.
2007/0235751 A1 10/2007 Radkov et al.
2007/0247089 A1 10/2007 Summerland
2007/0273299 A1 11/2007 Miskin et al.
2008/0037257 A1 2/2008 Bolta
2008/0062070 A1 3/2008 De Oto et al.
2008/0094000 A1 4/2008 Yamamoto et al.
2008/0116818 A1 5/2008 Shteynberg et al.
2008/0136331 A1 6/2008 Schmeikal
2008/0179602 A1 7/2008 Negley et al.
2008/0215279 A1 9/2008 Salsbury et al.
2008/0304260 A1 12/2008 van de Ven et al.
2009/0079362 A1 3/2009 Shteynberg et al.
2009/0160363 A1 6/2009 Negley et al.
2009/0184616 A1 7/2009 Van De Ven et al.
2009/0189529 A1 7/2009 Negley et al.
2009/0206758 A1 8/2009 Kobilke
2009/0237004 A1 9/2009 Ploquin et al.
2009/0243509 A1 10/2009 Barnett et al.
2009/0315480 A1 12/2009 Yan et al.
2010/0001648 A1 1/2010 De Clerq et al.
2010/0002440 A1 1/2010 Negley et al.
2010/0079262 A1 4/2010 Van Laanen
2010/0102199 A1 4/2010 Negley et al.
2010/0103660 A1 4/2010 van de Ven et al.
2010/0109570 A1 5/2010 Weaver
2010/0127282 A1 5/2010 Harbers et al.
2010/0127283 A1 5/2010 van de Ven et al.
2010/0134018 A1 6/2010 Tziony et al.
2010/0141159 A1 6/2010 Shiu et al.
2010/0259182 A1 10/2010 Man et al.
2010/0308738 A1 12/2010 Shteynberg et al.
2010/0315012 A1* 12/2010 Kim et al. ..... F21K 9/00 315/185 R
2011/0037413 A1 2/2011 Negley et al.
2011/0057571 A1* 3/2011 Ackermann ..... B61L 5/1881 315/158
2011/0062872 A1 3/2011 Jin et al.
2011/0068696 A1 3/2011 van de Ven et al.
2011/0068701 A1 3/2011 van de Ven et al.
2011/0068702 A1* 3/2011 van de Ven ..... H05B 33/083 315/186
2011/0084614 A1 4/2011 Eisele et al.
2011/0101883 A1 5/2011 Grajcar
2011/0115407 A1 5/2011 Wibben et al.
2011/0210678 A1 9/2011 Grajcar
2011/0254525 A1 10/2011 Gaknoki et al.
2011/0279061 A1* 11/2011 Lee ..... H05B 33/0815 315/307
2012/0025713 A1 2/2012 Ribarich et al.
2012/0104953 A1 5/2012 Chobot
2012/0153844 A1 6/2012 Chobot
2012/0176826 A1 7/2012 Lazar
2012/0201025 A1* 8/2012 Cash ..... F21K 9/135 362/231
2012/0206048 A1 8/2012 Yang
2012/0300452 A1* 11/2012 Harbers ..... H05B 33/0803 362/231
2012/0306375 A1* 12/2012 van de Ven ..... H05B 33/0863 315/122
2013/0002167 A1 1/2013 Van De Ven
2013/0026923 A1 1/2013 Athalye et al.
2013/0069561 A1 3/2013 Melanson et al.
2013/0077299 A1* 3/2013 Hussell ..... F21K 9/50 362/231
2013/0082610 A1 4/2013 Bradford
2013/0154508 A1* 6/2013 Gilliom ..... H02M 3/158 315/297
2013/0169159 A1 7/2013 Lys
2013/0207559 A1* 8/2013 Ferrier ..... H05B 33/0812 315/192
2016/0066381 A1 3/2016 Despesse

FOREIGN PATENT DOCUMENTS

JP 2003-273404 A 9/2003
JP 2008059811 3/2008
JP 2009-049010 A 3/2009
JP 2010/503164 1/2010
KR 10-2010-0040242 4/2010
KR 10-2011-0028204 A 3/2011
WO WO 2003/096761 A1 11/2003
WO WO 2008/129485 A1 10/2008

OTHER PUBLICATIONS

International Search Report and Written Opinion Corresponding to International Application No. PCT/US2012/039984; dated Nov. 30, 2012; 10 Pages.
International Search Report and Written Opinion Corresponding to International Application No. PCT/US2012/064434; dated Jan. 25, 2013; 11 Pages.
International Search Report and Written Opinion Corresponding to International Application No. PCT/US2012/040189; dated Aug. 20, 2012; 15 Pages.
Rensselaer Polytechnic Institute, "What is color consistency?". NLPIP, Lighting_Research Center, vol. 8, Issue 1, Oct. 2004, 3 Pages, Retrieved from http://www.Irc.rpi.edu/probrams/nlpip/lightinganswers/lightsources/whatisColorConsistency.asp.
Sutardja, P., "Design for High Quality and Low Cost SSL with

(56) References Cited

OTHER PUBLICATIONS

Power Factor Correction", Marvell Semiconductor Inc. Jul. 2011. 16 pages.
International Preliminary Report on Patentability Corresponding to International Application No. PCT/US2012/040189; dated Dec. 19, 2013; 13 Pages.
International Search Report and Written Opinion Corresponding to International Application No. PCT/US2014/032393; dated Aug. 11, 2014; 14 Pages.
Notification of Transmittal of the International Search Report and the Written Opinion of the International Searching Authority, or the Declaration, PCT/US14/68534, dated Mar. 4, 2015, 15 pages.
Notice of Preliminary Rejection Corresponding to Patent Application No. 10-2012-7029011; dated Nov. 19, 2015; 13 pages.
International Preliminary Report of Patentability, Corresponding to International Application No. PCT/US2014/032393; dated Oct. 6, 2015; 11 Pages.
International Preliminary Report on Patentability Corresponding to International Application No. PCT/US2014/068534; dated Jun. 16, 2016; 13 Pages.
Korean Notice of Preliminary Rejection for Korean Patent Application No. 10-2012-7029011; dated Jan. 16, 2017; Foreign Text, 5 Pages, English Translation Thereof, 4 Pages.
Author: James Frederick Lazar, Title: U.S. Utility provisional patent application for source and muitiple ioads regulator (U.S. Appl. No. 61/431,434), filed Jan. 11, 2011.
Author: James Frederick Lazar, Title: U.S. Utility provisional patent application for source and multiple loads regulator (U.S. Appl. No. 61/431,435), filed Jan. 11, 2011 (Drawings).
Korean Notice of Preliminary Rejection Corresponding to Korean Application No. 10-2012-7029011; dated May 10, 2016; Foreign Text, 6 pages, English Translation, 5 pages.

* cited by examiner

CIRCUITS AND METHODS FOR CONTROLLING SOLID STATE LIGHTING

CROSS-REFERENCE TO RELATED APPLICATIONS

The present application claims the priority of U.S. Provisional Application Ser. No. 61/808,553, filed on Apr. 4, 2013, and of U.S. Provisional Application Ser. No. 61/808,519, filed on Apr. 4, 2013, and is a Continuation-in-part of U.S. Non-provisional application Ser. No. 14/227,626, filed on Mar. 27, 2014, and is a Continuation-in-part of U.S. Non-provisional application Ser. No. 13/742,008, filed on Jan. 15, 2013, the entire disclosures of which are incorporated herein by reference.

FIELD OF THE INVENTION

The present invention relates to lighting apparatuses and methods and, more particularly, to solid state lighting apparatuses and methods.

BACKGROUND

Solid state lighting arrays are used for a number of lighting applications. For example, solid state lighting panels including arrays of solid state light emitting devices have been used as direct illumination sources, for example, in architectural and/or accent lighting. A solid state light emitting device may include, for example, a packaged light emitting device including one or more light emitting diodes (LEDs), which may include inorganic LEDs, which may include semiconductor layers forming p-n junctions, and/or organic LEDs (OLEDs), which may include organic light emission layers.

Visible light may include light having many different wavelengths. The apparent color of visible light can be illustrated with reference to a two dimensional chromaticity diagram, such as the 1931 International Conference on Illumination (CIE) Chromaticity Diagram illustrated in FIG. 1A, and the 1976 CIE u'v' Chromaticity Diagram shown in FIG. 1B, which is similar to the 1931 Diagram but is modified such that similar distances on the 1976 u'v' CIE Chromaticity Diagram represent similar perceived differences in color. These diagrams provide useful reference for defining colors as weighted sums of colors.

In the 1976 CIE Chromaticity Diagram, chromaticity values are plotted using scaled u- and v-parameters which take into account differences in human visual perception. That is, the human visual system is more responsive to certain wavelengths than others. For example, the human visual system is more responsive to green light than red/orange light. The 1976 CIE-u'v' Chromaticity Diagram is scaled such that the mathematical distance from one chromaticity point to another chromaticity point on the diagram is proportional to the difference in color perceived by a human observer between the two chromaticity points. A chromaticity diagram in which the mathematical distance from one chromaticity point to another chromaticity point on the diagram is proportional to the difference in color perceived by a human observer between the two chromaticity points may be referred to as a perceptual chromaticity space. In contrast, in a non-perceptual chromaticity diagram, such as the 1931 CIE Chromaticity Diagram, two colors that are not distinguishably different may be located farther apart on the graph than two colors that are distinguishably different.

As shown in FIG. 1A, colors on a 1931 CIE Chromaticity Diagram are defined by x and y coordinates (i.e., chromaticity coordinates, or color points) that fall within a generally U-shaped area. Colors on or near the outside of the area are saturated colors composed of light having a single wavelength, or a very small wavelength distribution. Colors on the interior of the area are unsaturated colors that are composed of a mixture of different wavelengths. White light, which can be a mixture of many different wavelengths, is generally found near the middle of the diagram, in the region labeled 100 in FIG. 1A. There are many different hues of light that may be considered "white," as evidenced by the size of the region 100. For example, some "white" light, such as light generated by sodium vapor lighting devices, may appear yellowish in color, while other "white" light, such as light generated by some fluorescent lighting devices, may appear more bluish in color.

Light that generally appears green is plotted in the regions 101, 102 and 103 that are above the white region 100, while light below the white region 100 generally appears pink, purple or magenta. For example, light plotted in regions 104 and 105 of FIG. 1A generally appears magenta (i.e., red-purple or purplish red).

It is further known that a binary combination of light from two different light sources may appear to have a different color than either of the two constituent colors. The color of the combined light may depend on the relative intensities of the two light sources. For example, light emitted by a combination of a blue source and a red/orange source may appear purple or magenta to an observer. Similarly, light emitted by a combination of a blue source and a yellow source may appear white to an observer.

Also illustrated in FIG. 1A is the Planckian locus 106, which corresponds to the location of color points of light emitted by a black-body radiator that is heated to various temperatures. In particular, FIG. 1A includes temperature listings along the Planckian locus. These temperature listings show the color path of light emitted by a black-body radiator that is heated to such temperatures. As a heated object becomes incandescent, it first glows reddish, then yellowish, then white, and finally bluish, as the wavelength associated with the peak radiation of the black-body radiator becomes progressively shorter with increased temperature. Illuminants which produce light which is on or near the Planckian locus can thus be described in terms of their correlated color temperature (CCT).

The chromaticity of a particular light source may be referred to as the "color point" of the source. For a white light source, the chromaticity may be referred to as the "white point" of the source. As noted above, the white point of a white light source may fall along the Planckian locus. Accordingly, a white point may be identified by a correlated color temperature (CCT) of the light source. White light typically has a CCT of between about 2000 K and 10000 K. White light with a CCT of 3000, may appear yellowish in color, while light with a CCT of 8000 K may appear more bluish in color. Color coordinates that lie on or near the Planckian locus at a color temperature between about 2500 K and 8000 K may yield pleasing white light to a human observer.

"White" light also includes light that is near, but not directly on the Planckian locus. A Macadam ellipse can be used on a 1931 CIE Chromaticity Diagram to identify color points that are so closely related that they appear the same, or substantially similar, to a human observer. A Macadam ellipse is a closed region around a center point in a two-dimensional chromaticity space, such as the 1931 CIE Chromaticity Diagram, that encompasses all points that are visually indistinguishable from the center point. A seven-step Macadam ellipse captures points that are indistinguishable to an ordinary observer within seven standard deviations, a ten step Macadam ellipse captures points that are indistinguishable to an ordinary observer within ten standard deviations, and so on. Accordingly, light having a color point that is within about a ten step Macadam ellipse of a point on the Planckian locus may be considered to have a substantially similar color as the point on the Planckian locus.

The ability of a light source to accurately reproduce color in illuminated objects is typically characterized using the color rendering index (CRI). In particular, CRI is a relative measurement of how the color rendering properties of an illumination system compare to those of a reference illuminator, with a reference illuminator for a CCT of less than 5000K being a black-body radiator. For CCT of 5000K and above, the reference illuminator is a spectrum defined by the CIE which is similar to the spectrum of sunlight at the earth's surface. The CRI equals 100 if the color coordinates of a set of test colors being illuminated by the illumination system are the same as the coordinates of the same test colors being irradiated by the reference illuminator. Daylight has the highest CRI (of 100), with incandescent bulbs being relatively close (about 95), and fluorescent lighting being less accurate (70-85).

Generally speaking, incandescent bulbs tend to produce more natural-appearing illumination than other types of conventional lighting devices. In particular, incandescent bulbs typically go from a color temperature of about 2700K at full brightness to a color temperature of about 2000 k at 5% brightness and to a color temperature of about 1800K at about 1% brightness. This compares favorably with daylight, which varies from about 6500K at midday to about 2500 k at sunrise and sunset. Research indicates that people tend to prefer warmer color temperatures at low brightness levels and in intimate settings.

In illumination applications, it is often desirable to provide a lighting source that generates a light with a color behavior that approximates the behavior of incandescent lighting. LED-lighting units have been proposed that may be coupled to an AC dimmer circuit and approximate the lighting variation of a conventional incandescent light as the dimmer circuit increases or decreases the brightness of the generated light, as described in U.S. Pat. No. 7,038,399 to Lys et al.

One difficulty with solid state lighting systems including multiple solid state devices is that the manufacturing process for LEDs typically results in variations between individual LEDs. This variation is typically accounted for by binning, or grouping, the LEDs based on brightness, and/or color point, and selecting only LEDs having predetermined characteristics for inclusion in a solid state lighting system. LED lighting devices may utilize one bin of LEDs, or combine matched sets of LEDs from different bins, to achieve repeatable color points for the combined output of the LEDs.

One technique to tune the color point of a lighting fixture is described in commonly assigned United States Patent Publication No. 2009/0160363, the disclosure of which is incorporated herein by reference. The '363 application describes a system in which phosphor converted LEDs and red/orange LEDs are combined to provide white light. The ratio of the various mixed colors of the LEDs is set at the time of manufacture by measuring the output of the light and then adjusting string currents to reach a desired color point. The current levels that achieve the desired color point are then fixed for the particular lighting device. LED lighting systems employing feedback to obtain a desired color point are described in U.S. Publication Nos. 2007/0115662 and 2007/0115228, the disclosures of which are incorporated herein by reference.

SUMMARY

Embodiments according to the invention can provide circuits and methods for controlling solid state lighting during dimming and lighting apparatus incorporating the same. Pursuant to such embodiments, a solid state lighting apparatus can include a plurality of light-emitting devices (LEDs) that are electrically coupled together in a string. The apparatus can further include a first LED segment that is configured to emit a first chromaticity light coupled across a first bypass circuit, a second LED segment that is configured to emit a second chromaticity light coupled across a second bypass circuit, and at least one additional LED segment that is configured to emit an additional chromaticity light coupled across a respective at least one additional bypass circuit. A control circuit can be configured to modulate the at least one additional bypass circuit, to cause the lighting apparatus to emit an additional v' shift in a chromaticity value of light emitted by the string to vary substantially in conformance with a Planckian locus in response to a dimming input to the control circuit.

In some embodiments according to the present invention, the control circuit is configured to modulate the at least one additional bypass circuit to cause the at least one additional LED segment to emit the additional v' shift in the chromaticity value of light in response to the dimming input. In some embodiments according to the present invention, the first LED segment includes at least one BSY LED and the at least one additional LED segment includes at least one BSY-Y LED.

In some embodiments according to the present invention, the additional chromaticity light includes a ccy coordinate value greater than about 0.5 in an x-y chromaticity space. In some embodiments according to the present invention, the additional chromaticity light can be a ccx coordinate value between about 0.55 and about 0.35 in an x-y chromaticity space.

In some embodiments according to the present invention, the control circuit is configured to modulate the at least one additional bypass circuit to generate the additional v' shift to provide a CCT value of less than about 1800K for the light in conformance with the Planckian locus in response to the dimming input. In some embodiments according to the present invention, the control circuit is configured to modulate the at least one additional bypass circuit to emit the additional v' shift to provide a CCT value of about 10,000K for the light in response to full on current in the string In some embodiments according to the present invention, the additional chromaticity light can be a predominant non-blue chromaticity. In some embodiments according to the present invention, the additional chromaticity light can be less than a saturated yellow chromaticity.

In some embodiments according to the present invention, the control circuit is configured to modulate the first bypass circuit to reduce a current through the first LED segment at a first rate when diming from full on and is configured to modulate the at least one additional bypass circuit to reduce a current through the at least one additional LED segment at a second rate when diming from full on.

In some embodiments according to the present invention, a method can be provided to operate a dimmable solid state lighting apparatus including a plurality of light-emitting devices (LEDs) coupled together in a string that includes a first modulated LED segment configured to emit a first chromaticity light, a second modulated LED segment configured to emit a second chromaticity light, and an additional modulated LED segment configured to emit an additional chromaticity light. The method can include providing a dimming input to the lighting, apparatus and modulating the additional modulated LED segment, using a control circuit coupled to the string, to cause the lighting apparatus to emit an additional v' shift in a chromaticity value of light emitted by the string to vary substantially in conformance with a Planckian locus in response to the dimming input.

In some embodiments according to the present invention, a method can be provided to operate a dimmable solid state lighting apparatus that includes a plurality of light-emitting devices (LEDs) coupled together in a string including a first LED segment configured to emit a first chromaticity light coupled across a first bypass circuit, a second LED segment configured to emit a second chromaticity light coupled across a second bypass circuit, and an additional LED segment configured to emit an additional chromaticity light coupled across an additional bypass circuit. The method can include receiving a dimming input to adjust light emitted by the string, determining a string current value indicating a current in the string developed responsive to the dimming input, stabilizing the string current value to provide a stabilized string current value, and then providing modulation control signals to bypass circuit across the LED segments based on the stabilized string current value to configure the string to emit an additional v' shift in a chromaticity value of light to vary substantially in conformance with a Planckian locus in response to the dimming input.

In some embodiments according to the present invention, a solid state lighting apparatus can include a plurality of light-emitting devices (LEDs) electrically coupled together in at least one string. The apparatus can include a first LED segment in a first string configured to emit a first chromaticity light, coupled across a first bypass circuit. A second LED segment can be in the first string configured to emit a second chromaticity light, coupled across a second bypass circuit. At least one additional LED segment can be configured to emit an additional chromaticity light, coupled across an additional bypass circuit and a control circuit can be configured to modulate the at least one additional bypass circuit, to cause the lighting apparatus to emit an additional v' shift in a chromaticity value of light emitted by the string to vary substantially in conformance with a Planckian locus in response to an input to change the chromaticity value of light emitted by the string.

DETAILED DESCRIPTION OF EMBODIMENTS ACCORDING TO THE INVENTION

Figure 1A:
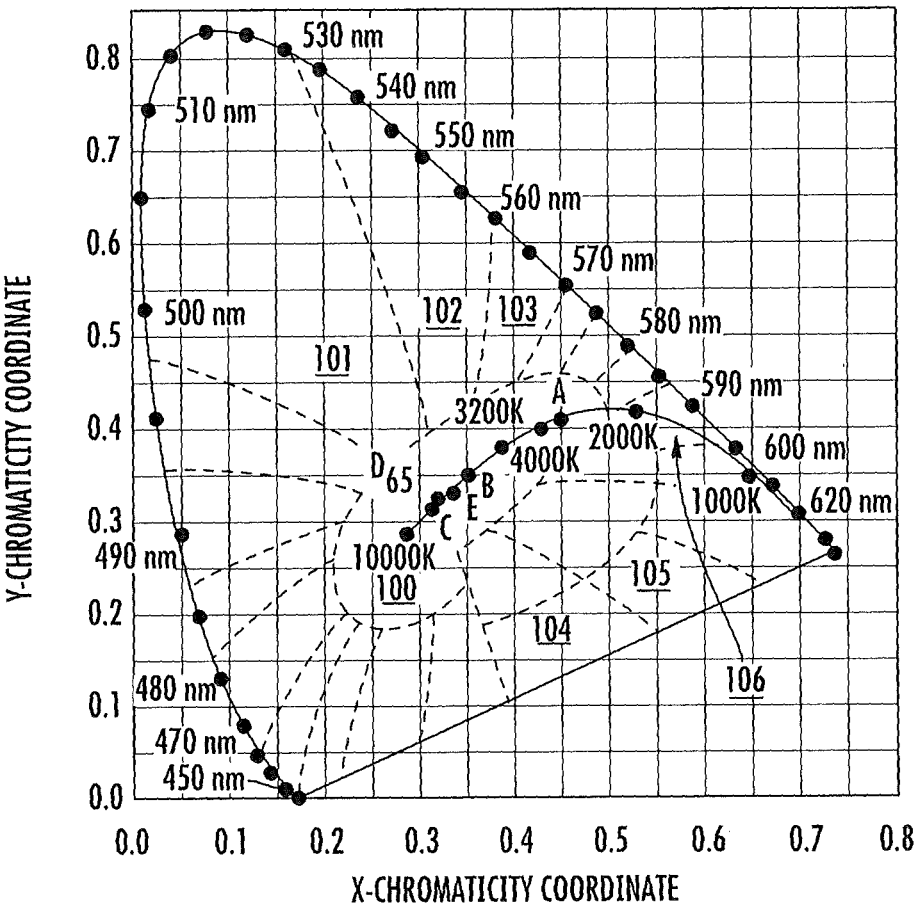
FIG. 1A is a chromaticity diagram illustrating a Planckian locus using x and y chromaticity coordinates.

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present inventive subject matter. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

The terminology used herein is for the purpose of describing particular embodiments only and is not intended to be limiting of the present inventive subject matter. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this present inventive subject matter belongs. It will be further understood that terms used herein should be interpreted as having a meaning that is consistent with their meaning in the context of this specification and the relevant art and will not be interpreted in an idealized or overly formal sense unless expressly so defined herein. The term "plurality" is used herein to refer to two or more of the referenced item.

The following description of some embodiments of the inventive subject matter refers to "light-emitting devices," which may include, but is not limited to, solid-state lighting devices, such as light emitting diode (LED) devices. As used herein, "LED" includes, but is not limited to, direct-emission devices that produce light when a voltage is applied across a PN junction thereof, as well as combinations of such direct-emission devices with luminescent materials, such as phosphors that emit visible-light radiation when excited by a source of radiation, such as a direct-emission device.

Embodiments of the present invention provide systems and methods for controlling solid state lighting devices and lighting apparatus incorporating such systems and/or methods. In some embodiments, the present invention can be utilized in connection with bypass circuits, using the current sensed in the LED string and the temperature associated therewith, as described in co-pending and commonly assigned U.S. patent application Ser. No. 12/566,195 entitled "Solid State Lighting Apparatus with Controllable Bypass Circuits and Methods of Operating Thereof", co-pending and commonly assigned U.S. patent application Ser. No. 12/704,730 entitled "Solid State Lighting Apparatus with Compensation Bypass Circuits and Methods of Operation Thereof" and co-pending and commonly assigned U.S. patent application Ser. No. 12/566,142 entitled "Solid State Lighting Apparatus with Configurable Shunts", the disclosures of which are incorporated herein by reference. Temperature compensation is described in co-pending and commonly assigned U.S. patent application Ser. No. 13/565,166, (P1513), entitled "Temperature Curve Compensation Offset" the disclosure of which is incorporated herein by reference.

Figure 2A:
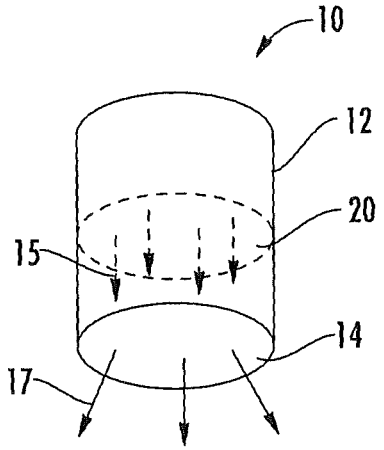
FIGS. 2A and 2B illustrate a solid state lighting apparatus in some embodiments according to the invention.
Figure 2B:
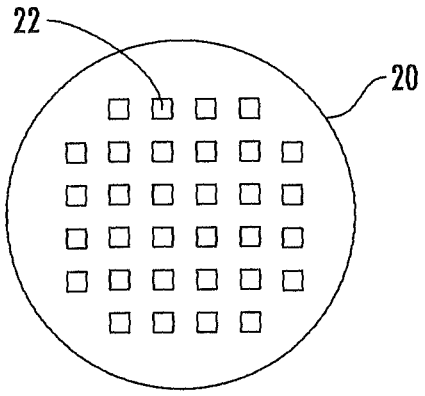

Referring to FIGS. 2A and 2B, a lighting apparatus 10 according to some embodiments is illustrated. The lighting apparatus 10 shown in FIGS. 2A and 2B is a "recessed downlight" or "can" lighting fixture that may be suitable for use in general illumination applications as a down light or spot light. However, it will be appreciated that a lighting apparatus according to some embodiments may have a different form factor. For example, a lighting apparatus according to some embodiments can have the shape of a conventional light bulb, a pan or tray light, an automotive headlamp, or any other suitable form.

The lighting apparatus 10 generally includes a can shaped outer housing 12 in which a lighting panel 20 is arranged. In the embodiments illustrated in FIGS. 2A and 2B, the lighting panel 20 has a generally circular shape so as to fit within an interior of the cylindrical housing 12. Light is generated by LEDs 22, which are mounted on the lighting panel 20, and which are arranged to emit light 15 towards a diffusing lens 14 mounted at the end of the housing 12. Diffused light 17 is emitted through the lens 14. In some embodiments, the lens 14 may not diffuse the emitted light 15, but may redirect and/or focus the emitted light 15 in a desired near-field or far-field pattern. The LEDs 22 may include LEDs of different chromaticities that may be selectively controlled to produce a desired intensity, correlated color temperature (CCT) and/or color rendering index (CRI) using various techniques discussed in detail below.

As appreciated by the present inventors, some solid state lighting solutions are unable to provide light which adequately follows the Planckian locus illustrated in FIGS. 1A/1B. In particular, as some conventional lighting systems are dimmed toward the lower ranges of the Planckian locus (for example, below 1800K) the light produced by the apparatus may appear to be too red. As further appreciated by the present inventors, an additional LED device may be added to a lighting apparatus that already includes LEDs selected from bins such as blue-shifted-yellow and red/orange.

The additional LEDs can be selected to provide an additional v' lighting component to selectively shift the chromaticity of the combined light generated by the LEDs in a direction in the u'-v' space, that allows the light to more closely follow the Planckian locus over a wide range of dimming. For example, in some embodiments according to the invention, the lighting apparatus may already include a combination of blue-shifted-yellow LEDs and red/orange LEDs. Without an additional LED, however, as the light from the apparatus is dimmed (for example, below about 1800K) the light generated by the lighting apparatus may be a result of a combination of the blue-shifted-yellow LEDs and the red/orange LEDs, which may cause the chromaticity of the light output of the apparatus to fall below the Planckian locus in the chromaticity space shown in FIG. 1. To address this, the additional LEDs can add an additional v' component, for example, when the dimming of the lighting apparatus reaches the point where the combination of the blue-shifted-yellow and red/orange LEDs would otherwise produce light having a chromaticity that is below the Planckian locus.

For example, in some embodiments according to the invention, as the lighting apparatus produces dimmer light, some of the current passing through the blue-shifted-yellow LEDs can be bypassed through additional LED components thereby providing increasingly greater amounts of the v' component to shift the chromaticity of the combined light from the apparatus toward the Planckian locus as the dimming progresses.

In some embodiments according to the invention, the additional LEDs can be amber LEDs that are configured to emit amber light which generates light having a dominant wavelength in a range from about 585 nm to about 500 nm. The amber LEDs are positioned in the CIE chromaticity diagram so as to provide the additional v' component so that the combined light generated by the lighting apparatus can follow the Planckian locus over a wider range of dimming than in conventional systems. Although amber LEDs are described herein as being used as the additional LEDs in such lighting apparatus, it will be understood that any LED that is configured to emit a color that is situated in the CIE chromaticity space so as to provide the needed v' component used to shift the chromaticity of the light generated by the apparatus onto the Planckian locus, may be utilized.

Figure 1B:
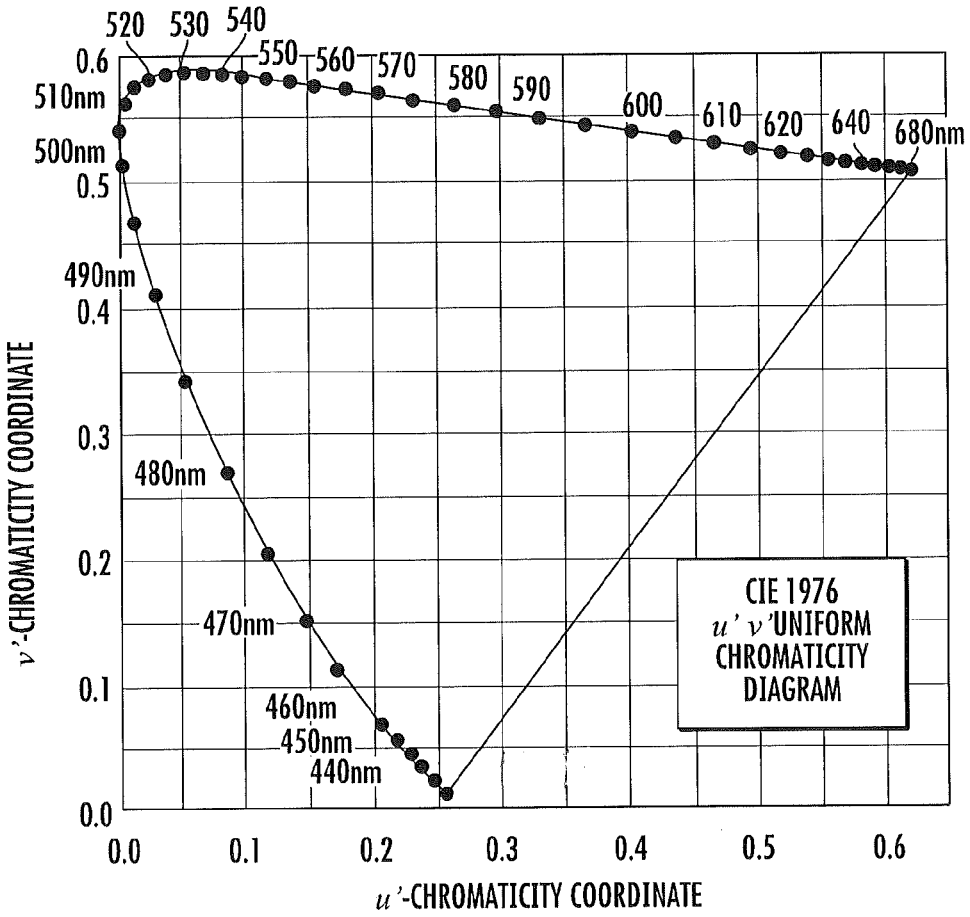
FIG. 1B is a chromaticity diagram using u' and v' chromaticity coordinates.
Figure 3:
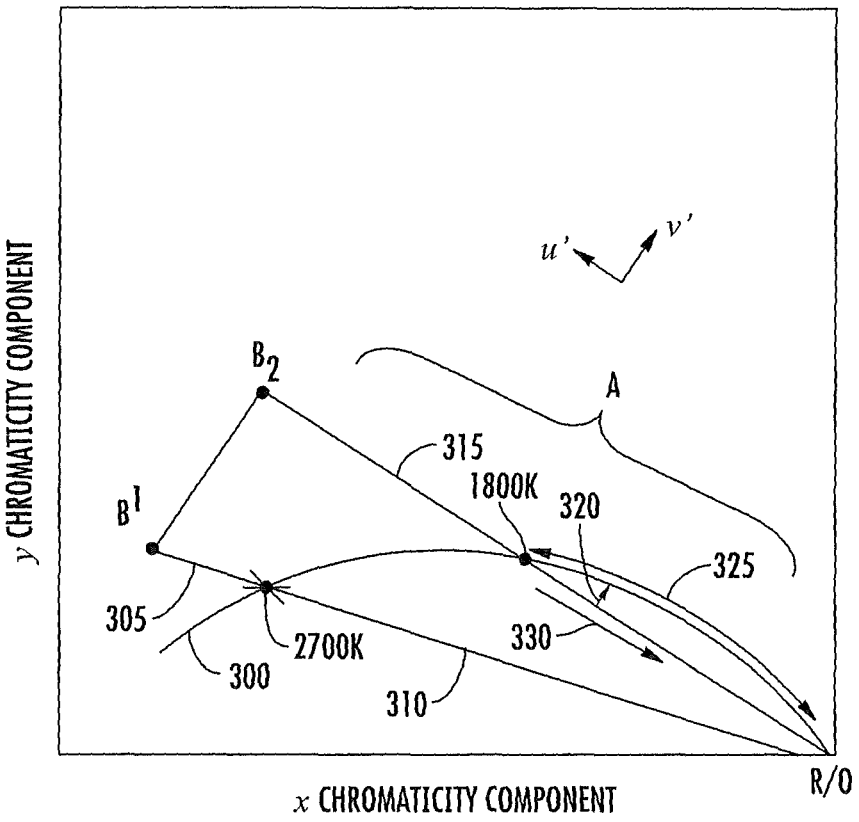
FIG. 3 is a portion of an x-y chromaticity diagram (annotated with an offset u' and v' coordinate system) illustrating the Planckian locus overlayed with points illustrating different chromaticities associated with LEDs including additional LEDs in some embodiments according to the invention.

FIG. 3 is a schematic representation of a portion of the CIE chromaticity diagram shown in FIG. 1 (annotated with an offset u' and v' coordinate system) overlayed with the additional v' component generated by the additional LEDs in some embodiments according to the invention. According to FIG. 3, LEDs B1 correspond to blue-shifted-yellow (BSY) LEDs that are configured to emit BSY light, whereas LEDs B2 correspond to BSY LEDs that are configured to emit BSY light that has a greater yellow content than the LEDs B1. Accordingly, BSY LEDs B1 and B2 are shown separated from one another in the chromaticity space of FIG. 3. Also, the red/orange LEDs RIO are configured to emit red/orange light and are shown near the lowest end of the Planckian locus 300 corresponding to when the light generated by the apparatus is at the lowest level of brightness.

As further shown in FIG. 3, the additional LEDs A are shown situated in the chromaticity space above a locus 315 that connects the BSY LEDs B2 and the red/orange LEDs R. Situating the additional LEDs A in this portion of the chromaticity space allows for the generation of an additional v' component 320 that allows the light to be shifted toward the Planckian locus 300 when the dimming level results in the apparatus generating light that is less than 1800K.

For example, in operation, each of the LEDs shown can be configured to emit its respective light, all of which are combined to generate combined light that should ideally follow the Planckian locus 300 over the widest range of dimming. Initially, the BSY LEDs B1 and the red/orange LEDs RIO can generate light which combines to produce 2700K output which falls directly on the Planckian locus 300. This output is generated by the light output 305 from the BSY LED B1 and a light 310 generated by the red/orange LEDs R/O to place the light output on the Planckian locus at 2700K. As the light output from the apparatus is dimmed, however, the BSY LEDs B2 can be included in the generation of light to shift combined light from the apparatus upward in the v' direction to follow the Planckian locus as the dimming proceeds towards 1800K.

Once the dimming reaches 1800K, however, it is shown that the portion of the Planckian locus 325 below 1800K extends beyond the locus 315 that connects the BSY LEDs B2 and the red/orange LEDs R/O. Accordingly, and as appreciated by the present inventors, if no additional LED components are provided, the light generated by the apparatus may follow the remainder of the locus 315 that connects the BSY LEDs B2 and the red/orange LEDs R/O below 1800K. The inclusion of the additional LEDs, however, provides for the additional v' component 320 that can shift the light generated by the apparatus upward in the v' direction to more closely follow the portion of the Planckian locus 325 that falls below 1800K as the light provided by the apparatus is further dimmed.

It will be understood that although the representation shown in FIG. 3 shows 3 types of LEDs utilized with the additional LEDs (i.e., the two BSY type LEDs along with the red/orange LEDs) an apparatus may be provided which includes 2 types of LEDs: a BSY LED, a red/orange LED, along with the additional LED, which is configured to emit light to provide the v' component as discussed herein.

It will be understood that in some embodiments according to the invention, the BSY and R/O LEDs can be any chromaticity LEDs that can be used to generate dimmable light that can follow the Planckian locus 300 until the additional LED is used to shift the light using the additional v' component 320. Accordingly, the inclusion of BSY and R/O (and amber) LEDs in some embodiments is for the purpose of illustration and is not intended to be a limitation as to what chromaticity LEDs may be used in embodiments according to the invention.

BSY devices may include, for example, LED devices that include a combination of a blue excitation diode and a phosphor, as described in U.S. Pat. No. 7,213,940, issued May 8, 2007, and entitled "LIGHTING DEVICE AND LIGHTING METHOD," the disclosure of which is incorporated herein by reference. As described therein, a lighting device may include solid state light emitters (i.e., LED devices) which emit light having dominant wavelength in ranges from 430 nm to 480 nm, and a group of phosphors which emit light having dominant wavelength in the range from 555 nm to 585 nm. A combination of light by the first group of emitters, and light emitted by the group of phosphors produces a sub-mixture of light having x, y color coordinates within a BSY area on a 1931 CIE Chromaticity Diagram. Such non-white light may, when combined with light having a dominant wavelength from 600 nm to 630 nm, can be used to produce warm white light over a portion of the Planckian locus that is subjected to a wider range of dimming. See U.S. Pat. No. 7,821,194, issued Oct. 26, 2010 and entitled "SOLID STATE LIGHTING DEVICES INCLUDING LIGHT MIXTURES," the disclosure of which is incorporate herein by reference.

It will be understood that production LEDs generally exhibit variation in chromaticity, e.g., LEDs in a lot of BSY LEDs may vary in chromaticity. "Bins" may be defined for such BSY LEDs, e.g., respective bins may be assigned respective ranges of chromaticity values, and LEDs may be sorted according to where they fall with respect to these ranges. In some embodiments, bluer BSY LEDs may be selected from a first bin and yellower BSY LEDs may be selected from a second bin such that, for example, there is v' variation of 0.005 or greater between the first and second bins.

As further described herein, the additional v' component described above can be provided by, for example, controlling the different LEDs to reduce the current through at least one of the BSY LEDs while also increasing the current through at least one additional LED to cause a color temperature that varies substantially in conformance with the Planckian locus in response to a dimming input. In other words, as the current through the BSY LEDs is reduced as a result of dimming, a current can be increased through the additional LEDs, such as an amber LED. Increasing the light generated by the additional LEDs when the current provided through the BSY LEDs is being reduced can allow for the generation of the additional v' component described herein. Furthermore, it will be understood that although amber colored LEDs are described herein as being used to generate the additional v' component, any color LED that provides a sufficient v' component over a range of dimming provided to the apparatus can be utilized in embodiments according to the invention.

Figure 4:
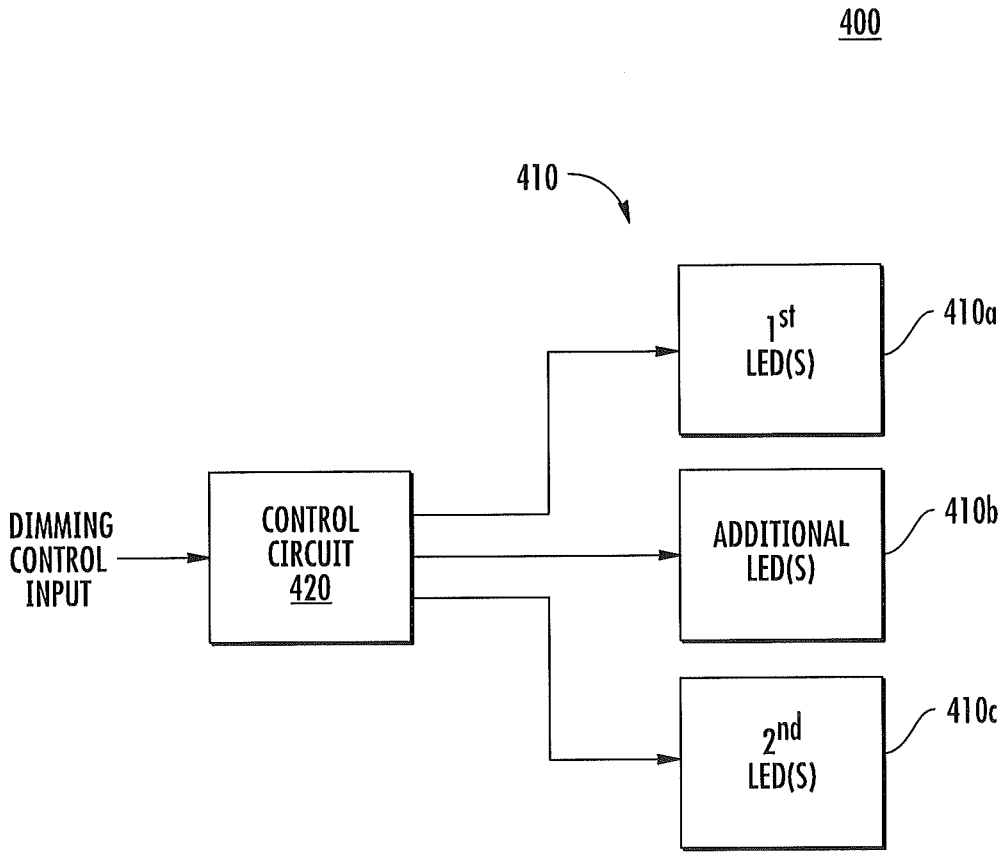
FIG. 4 is a block diagram illustrating a lighting apparatus in some embodiments according to the invention.

FIG. 4 is a block diagram illustrating an apparatus 400 including a plurality of LEDs in some embodiments according to the invention. As shown in FIG. 4, a control circuit 420 is provided with a dimming input to affect the overall brightness level provided by the apparatus 400. In particular, the control circuit 420 can control current provided through a plurality of LEDs in response to the dimming input to affect the brightness of the apparatus 400.

As further shown in FIG. 4, the plurality of LEDs 410 can include first LEDs (such as blue-shifted-yellow LEDs) 410A, second LEDs (such as red/orange LEDs) 410C, and additional LEDs (such as amber LEDs) 410B. The first LEDs 410A are configured to emit first light of a first chromaticity, the second LEDs 410C are configured to emit second light of a second chromaticity, and the additional LEDs 410B are configured to emit third light of a third chromaticity. It will be further understood that the embodiments illustrated in FIG. 4 are described hereinbelow using exemplary chromaticities for certain ones of the LEDs in the plurality of LEDs 410, although no limitation is intended by the use of these exemplary chromaticities.

It will be understood that the control circuit 420 is operatively coupled to the plurality of LEDs 410 so as to reduce current through at least one of, for example, the BSY LEDs 410A while increasing the current through at least one of the additional LEDs 410B. This operation can then cause a color temperature that is produced by the plurality of LEDs 410 that varies substantially in conformance with the Planckian locus in response to a dimming input. Moreover, as a level of dimming provided by the dimming input approaches a level whereupon a portion of the Planckian locus 325 shown in FIG. 3 is to be followed, the current through the additional LEDs 410 can be increased to provide the additional v' component 320 while the current of the BSY LEDs 410A is reduced which would otherwise cause the light output to follow the path 330 shown in FIG. 3 along the locus 315, which may be significantly removed from the Planckian locus 300.

It will be understood that the control circuit 420 can be provided based, with the addition of the teaching provided herein, on the systems, circuits, and methods described in commonly assigned U.S. patent application Ser. No. 12/566,195 entitled "Solid State Lighting Apparatus with Controllable Bypass Circuits and Methods of Operating Thereof", co-pending and commonly assigned U.S. patent application Ser. No. 12/704,730 entitled "Solid State Lighting Apparatus with Compensation Bypass Circuits and Methods of Operation Thereof" and co-pending and commonly assigned U.S. patent application Ser. No. 12/566,142 entitled "Solid State Lighting Apparatus with Configurable Shunts", the disclosures of which are incorporated herein by reference. Temperature compensation is described in co-pending and commonly assigned U.S. patent application Ser. No. 13/565,166, (P1513), entitled "Temperature Curve Compensation Offset" the disclosure of which is incorporated herein by reference. The operations described therein can be applied to the present disclosure to control the bypass circuits to provide, for example, dimming control and temperature compensation for the lighting apparatus.

Figure 5:
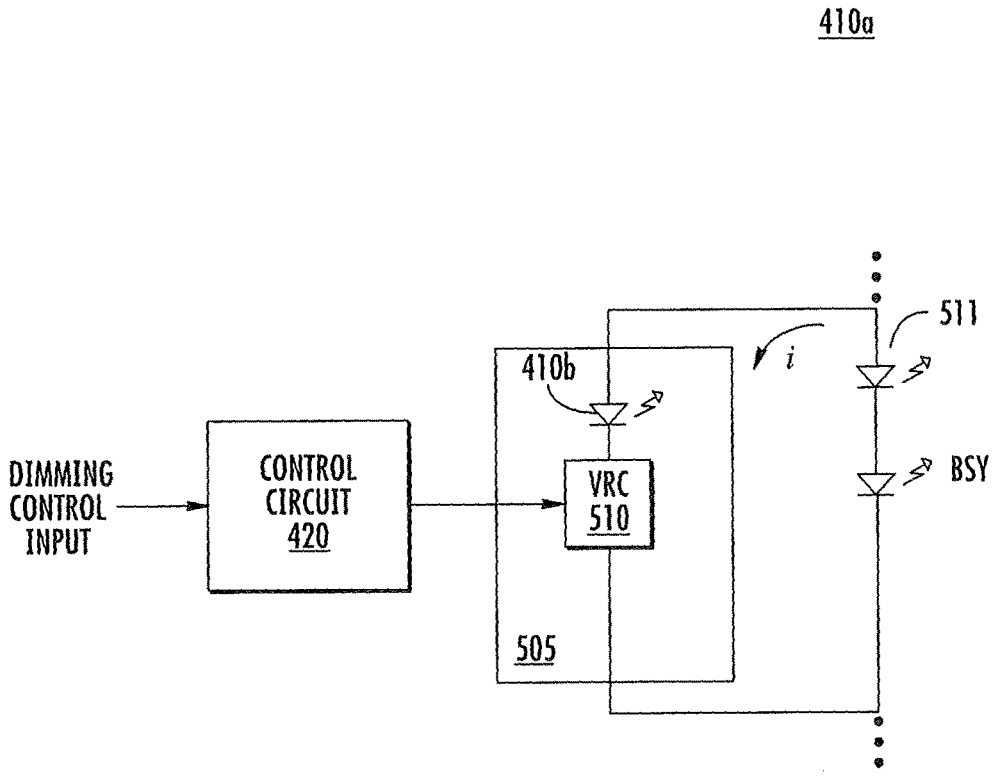
FIG. 5 is a schematic diagram illustrating a bypass circuit coupled to a control circuit and a plurality of LEDs in some embodiments according to the invention.

FIG. 5 is a schematic diagram illustrating a bypass circuit 505 (sometimes referred to as a shunt) operatively coupled to the control circuit 420 and to BSY LEDs 511 in some embodiments according to the invention. According to FIG. 5, the bypass circuit 505 is coupled in parallel with the portion of the plurality of LEDs 410 that includes at least one of the BSY LEDs 511.

The bypass circuit 505 includes at least one of the additional LED 410B coupled in series with a variable resistance circuit 510, both of which are coupled in parallel with the BSY LEDs 511. In operation, the dimming input is provided to the control circuit 420 to indicate that the brightness level of the apparatus should be reduced. In response, the control circuit 420 changes the resistance provided by the variable resistance circuit 510 so as to bypass additional current i from the BSY LEDs 511 through the at least one additional LED 410B, therefore causing the at least one additional LED 410B to emit light to provide the additional v' component described above in reference to FIG. 3. Additionally, the current provided to the BSY LEDs 511 is reduced so as to provide the bypass current to the at least one additional LED 410B. As the dimming input indicates the brightness level should be further reduced, the amount of current bypassed through the at least one additional LED 410B by the variable resistance circuits 510 can be increased, thereby causing additional light output from the at least one additional LED 410B, whereas the current through the BSY LEDs 511 is further reduced.

Figure 11:
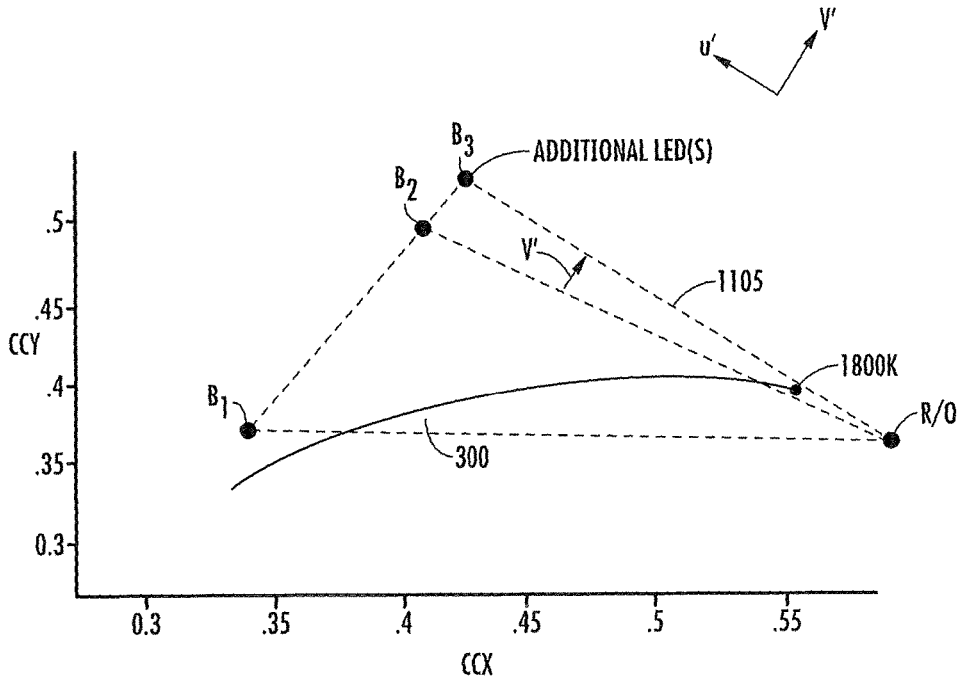
FIG. 11 is a portion of an X-Y chromaticity diagram (annotated with an offset u' and v' coordinate system) illustrating the Planckian locus overlayed with points illustrating different chromaticities associated with LEDs including additional LEDs in further embodiments according to the invention.
Figure 12:
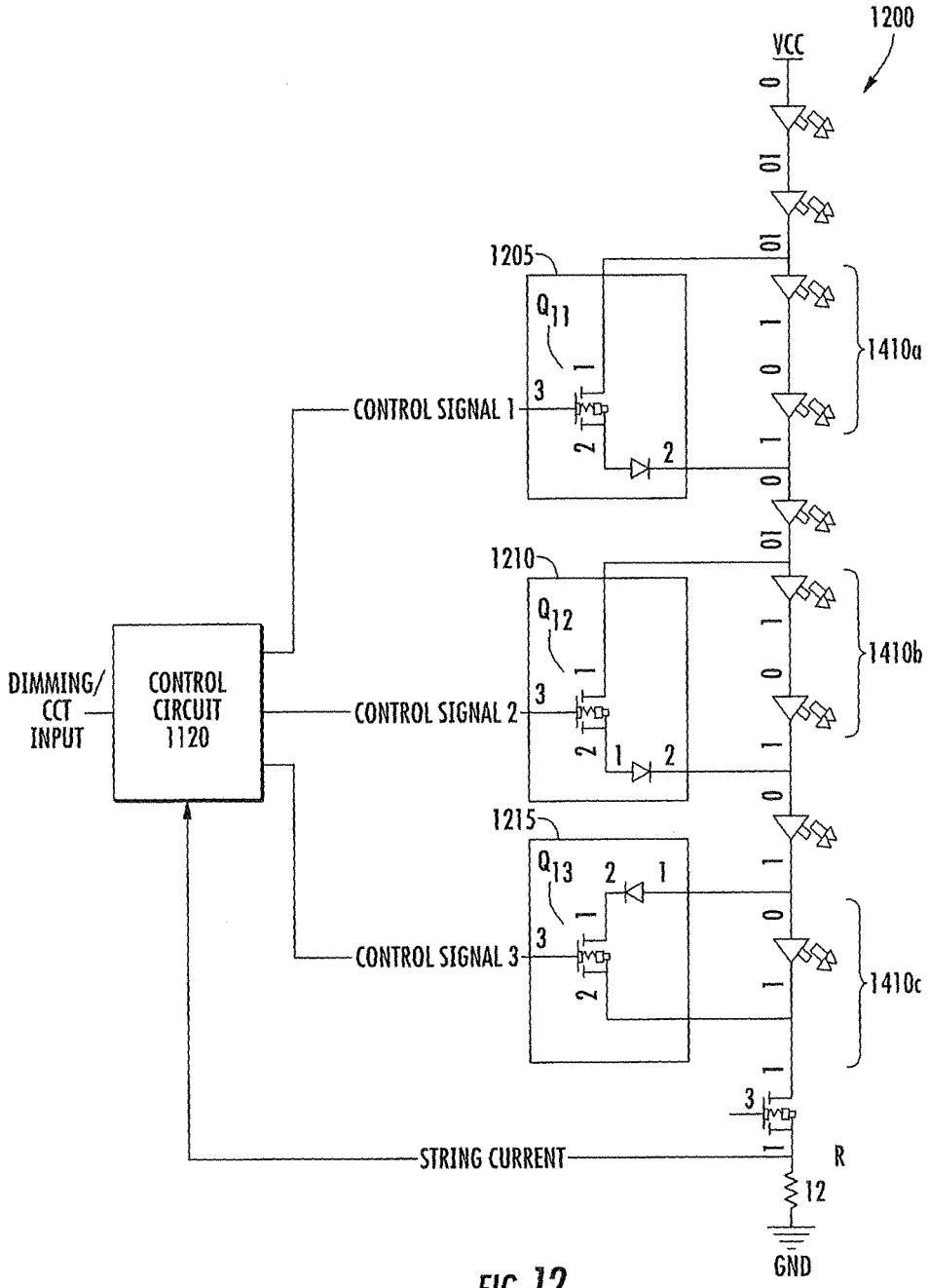
FIG. 12 is a schematic diagram illustrating bypass circuits coupled across respective LEDs in further embodiments according to the invention.
Figure 13:
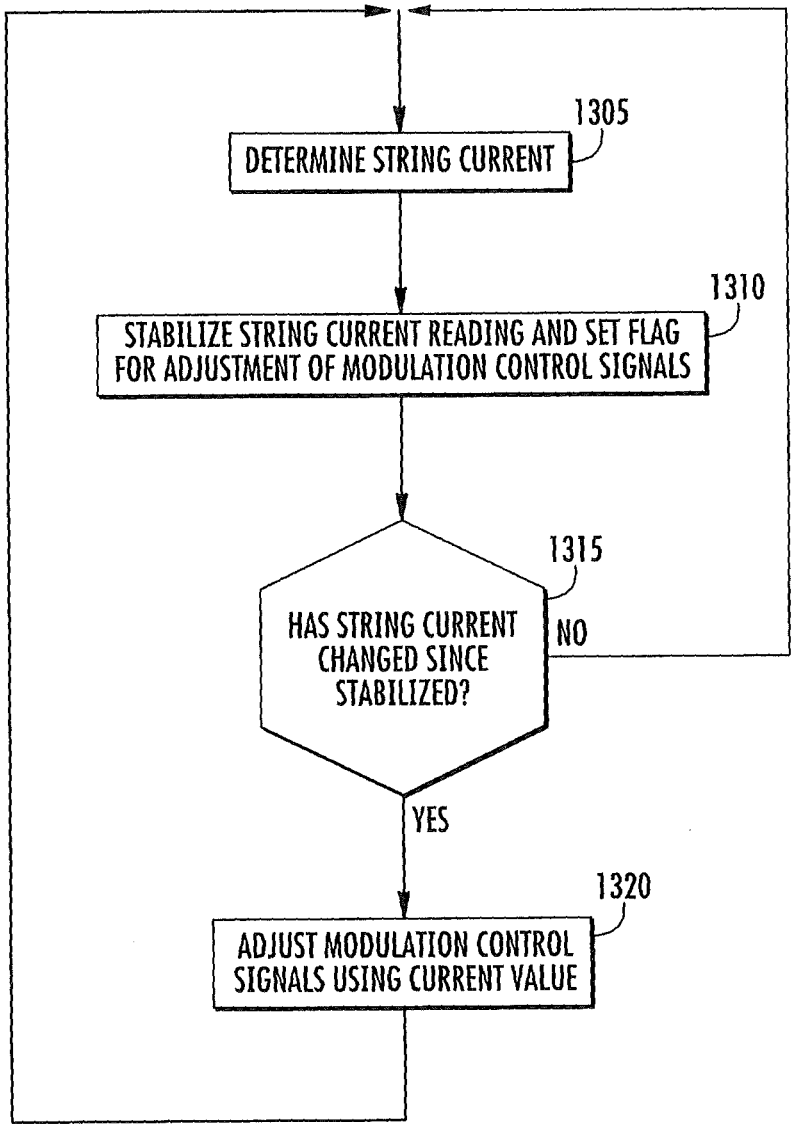
FIG. 13 is a flowchart illustrating operations of control circuits configured to provide control signals to bypass circuits coupled across LEDs in further embodiments according to the invention.

Although the bypass circuit 505 is described above as including at least one additional LED, it will be understood that in some embodiments according to the invention the bypass circuit does not include an additional LED, but rather the additional LED can instead be coupled across the bypass circuit (e.g., in an additional LED segment) to provide the additional v' shift to the chromaticity of the light provided by the lighting apparatus to stay on the Planckian locus over a wide range of dimming, as described, for example, in conjunction with FIGS. 11-13.

Figure 6:
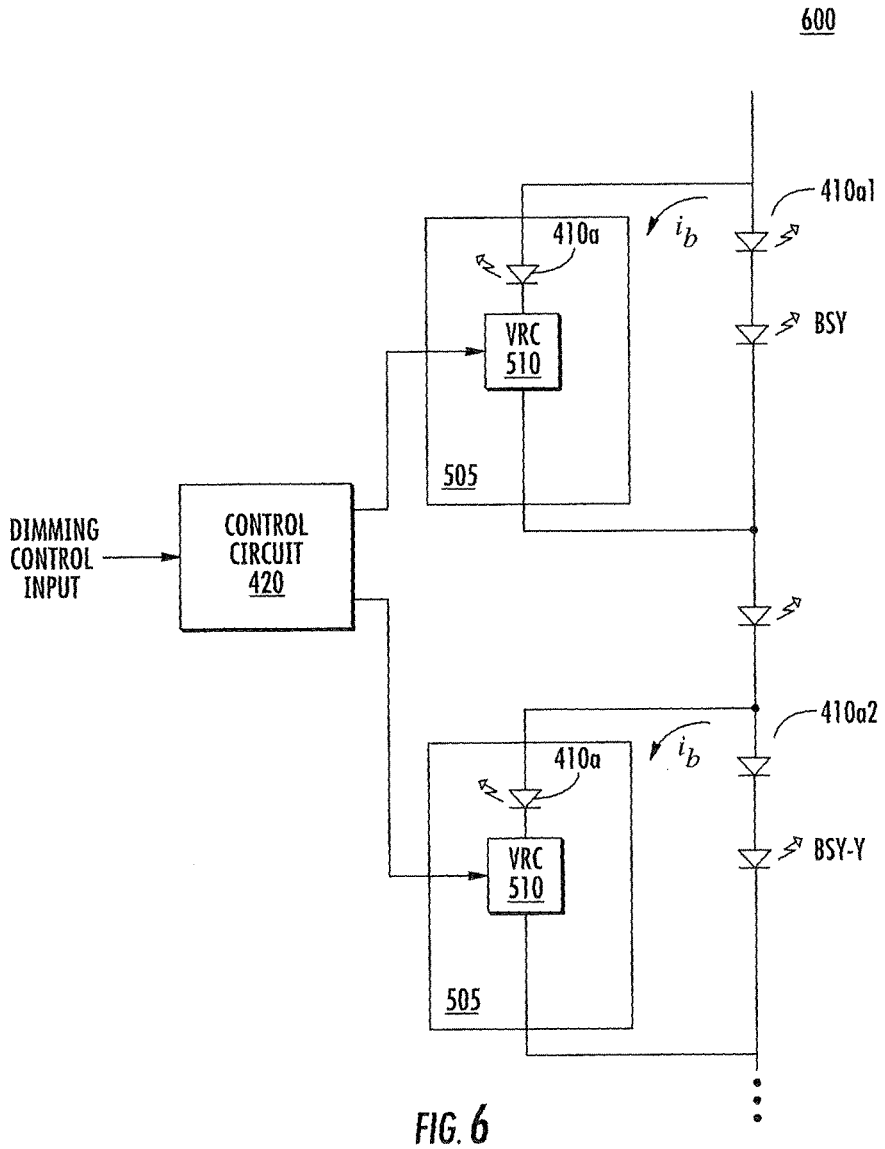
FIG. 6 is a schematic diagram illustrating first and second bypass circuits coupled to a control circuit and across different ones of the LEDs in some embodiments according to the invention.

FIG. 6 is a schematic diagram illustrating a lighting apparatus 600 including a plurality of LEDs 410 coupled to a plurality of bypass circuits in some embodiments according to the invention. According to FIG. 6, a dimming input is provided to the control circuit 420 which in turn controls a first bypass circuit 505 coupled to a first group of BSY LEDs 410*a*1 and a second bypass circuit 505 coupled in parallel with a second set of BSY LEDs 410*a*2. It will be understood that the second set of BSY LEDs 410*a*2 includes LEDs which emit yellower content light compared to the light emitted by BSY LEDs 410*a*1.

Each of the bypass circuits 505 includes a variable resistance circuit 510 that is operatively coupled to the control circuit 420. Each of the bypass circuits 505 also includes at least one additional LED 410A coupled in series therewith so that when the control circuit 420 changes the resistance provided by the variable resistance circuit 510 in each of the bypass circuits, the amount of current $i_b$ provided through each of the at least one additional LEDs 410A varies, thereby changing the amount of light emitted by the additional LEDs 410A. Accordingly, as shown in FIG. 6, in some embodiments according to the invention, the additional LEDs can be provided in multiple bypass circuits coupled across different ones of the LEDs included in the plurality of LEDs 410.

Figure 7:
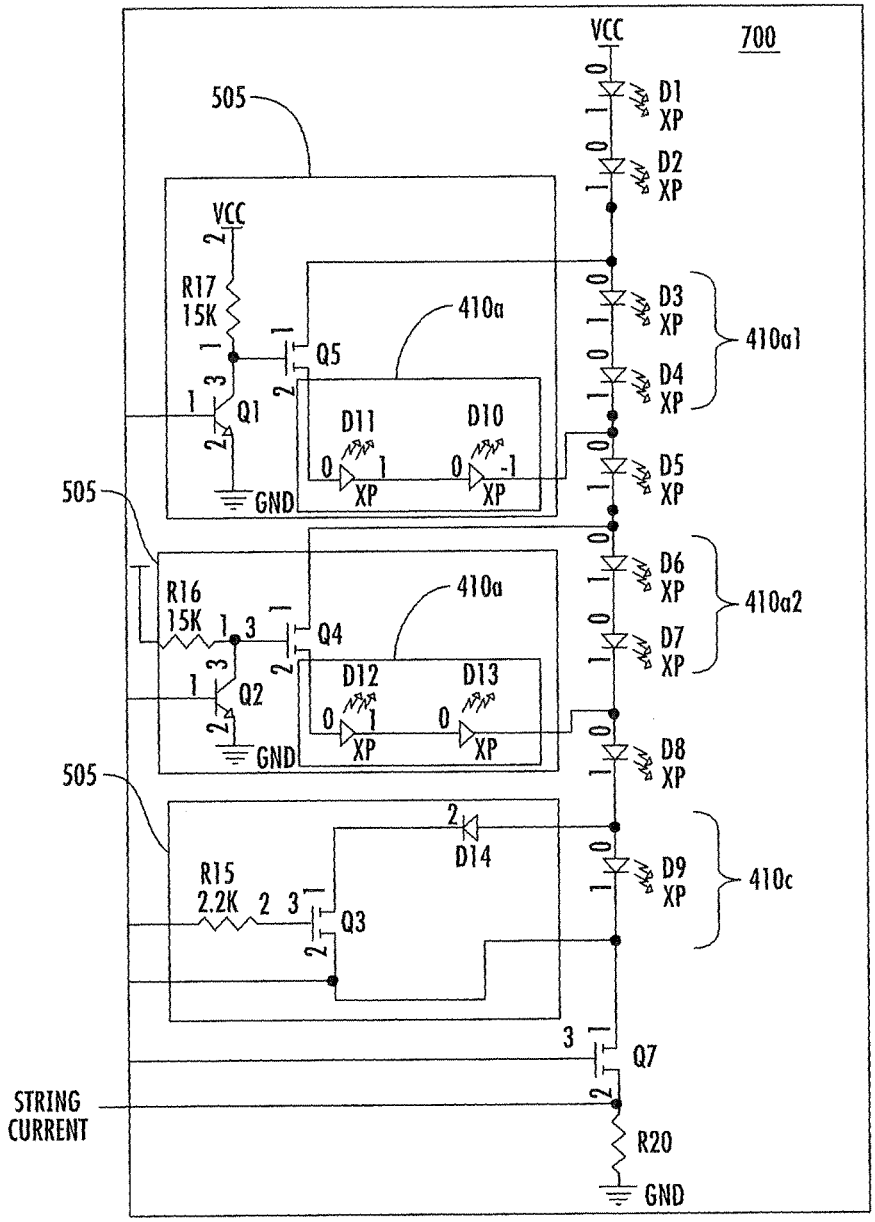
FIG. 7 is a schematic diagram illustrating bypass circuits coupled across respective LEDs in some embodiments according to the invention.

FIG. 7 is a detailed schematic diagram for a lighting apparatus 700 including the plurality of LEDs and bypass circuits coupled thereto with additional LEDs included therewith in some embodiments according to the invention. According to FIG. 7, amber LEDs provide the additional LEDs included with the bypass circuits 505 coupled across the BSY LEDs 410*a*1 and BSY LEDs 410*a*2, respectively. In particular, each of the bypass circuits 505 provides a transistor based variable resistance circuit which is operatively coupled to the control circuit 420 to vary the amount of current provided through the amber LEDs included in the bypass circuits 505.

In operation, the variable resistance circuits included with the bypass circuits 505 are configured to maintain proper operation of the transistors Q4 and Q5 during dimming. For example, the amber LEDS included in the bypass circuits 505 are selected to provide proper biasing to the transistors Q4 and Q5 so that during dimming, the transistors Q4 and Q5 may be maintained in saturation mode so that the current can continue to flow through the amber LEDs to provide the additional v' component described above in reference to FIG. 3.

It will be understood that the bypass circuit 505 shown coupled across the red/orange LEDs 410C may not include amber LEDs, but can include non-light emitting diodes to provide prober biasing of the transistor Q3. It will be further understood that the resistor R20 can be used to indicate the current through the LED string to the control circuit (via the voltage across R20). The LED string current can be used to control the bypass circuits as described herein. The temperature associated with the LED string can also be used by the control circuit to control the bypass circuits, using, for example, a 47.5K Ohm thermistor.

Figure 8:
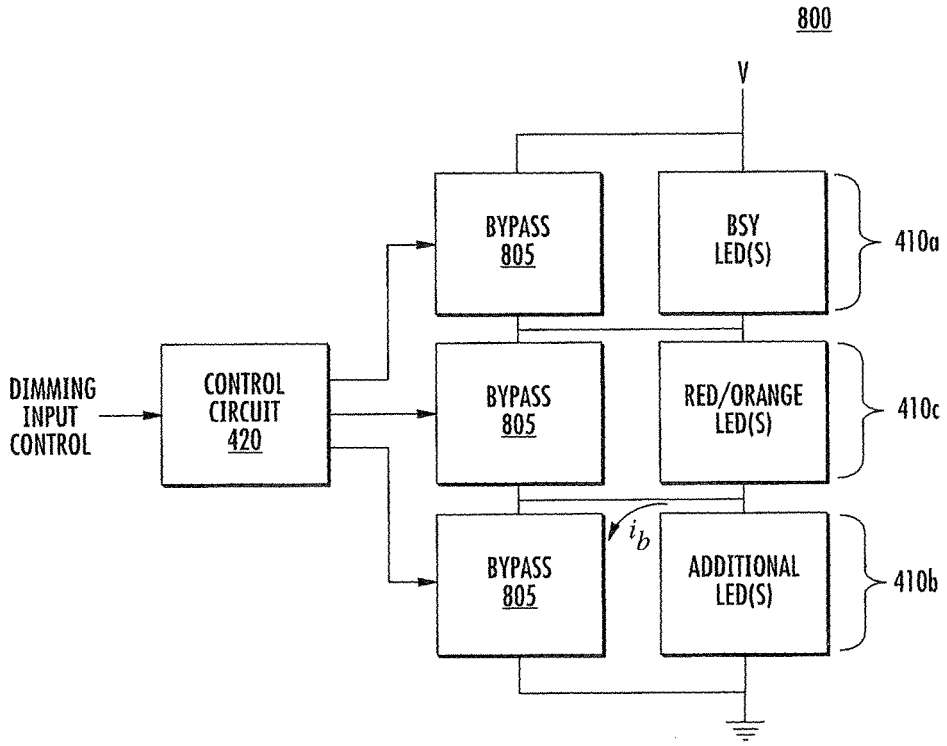
FIG. 8 is a block diagram illustrating several bypass circuits coupled across the LEDs in some embodiments according to the invention.

FIG. 8 is a block diagram that illustrates operations of a lighting apparatus 800 in some embodiments according to the invention. According to FIG. 8, the plurality of LEDs included in the lighting apparatus includes at least one BSY LED 410A coupled in series with at least one red/orange LED 410C which is coupled in series with at least one additional LED 410B. The lighting apparatus 800 also includes corresponding bypass circuits 805 coupled in parallel with each of the LEDs 410A-C. It will be understood that the bypass circuits 805 coupled across the at least one blue LED 410A and the at least one red/orange LED 410C can be utilized to effect the brightness level of the lighting apparatus 800 in response to the dimming input control provided to the control circuit 420.

Still further, the bypass circuit 805 coupled in parallel with the at least one additional LED 410B is configured to bypass current around the at least one additional LED 410B until significant dimming of the lighting apparatus 800 is to be provided. In other words, the bypass circuit 805 is configured to conduct current around the at least one additional LED 410B so that the additional v' component provided by the at least one additional LED 410B is not provided until a level of dimming that calls for the additional v' component. At this dimming level, the control circuit 420 can affect the operation of the bypass circuit 805 so as to reduce the current $i_b$ as the dimming input control increases thereby increasing the amount of current provided through the at least one additional LED 410B to provide the additional v' component to maintain operation of the lighting apparatus 800 in substantial conformance with the Planckian locus in response to the dimming input control.

Figure 9:
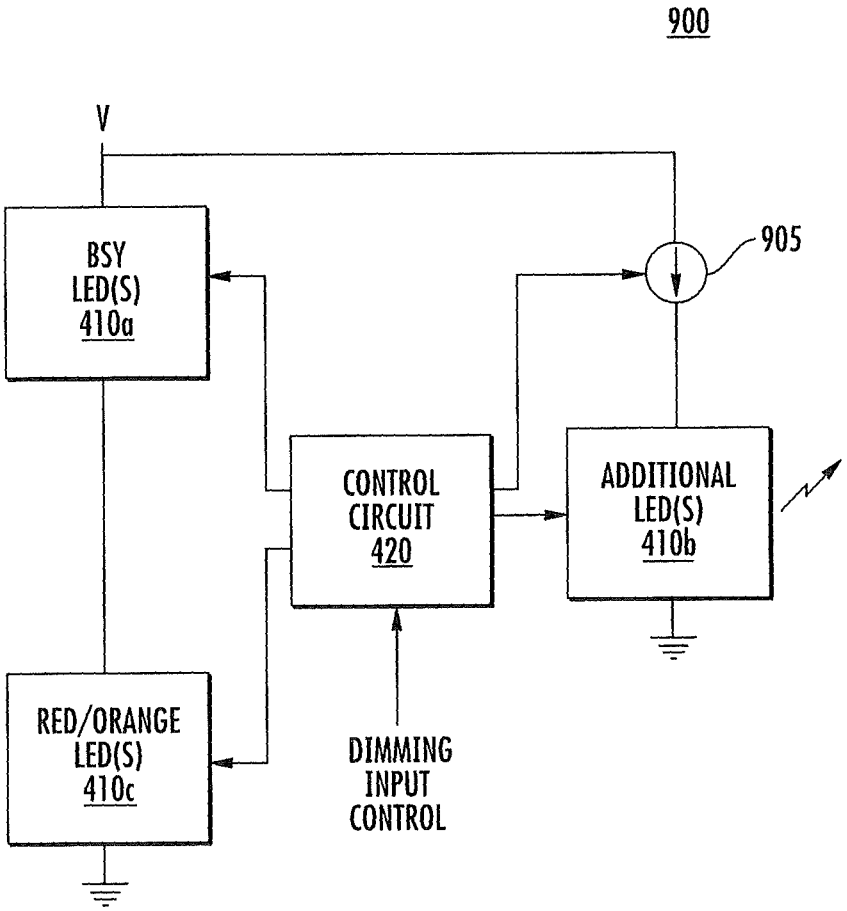
FIG. 9 is a block diagram illustrating a control circuit coupled to different LEDs in some embodiments according to the invention.

FIG. 9 is a block diagram that illustrates the plurality of LEDs provided in separate strings in a lighting apparatus 900 in some embodiments according to the invention. According to FIG. 9, the at least one BSY LED 410A is coupled in series with the at least one red/orange LED 410C, both of which are operatively coupled to the control circuit 420. In operation, the control circuit 420 can modify the current provided through the at least one BSY LED 410A and the at least one red/orange LED 410C to effect the overall brightness level provided by the lighting apparatus 900. In addition, the control circuit 420 is operatively coupled to the additional LEDs 410B which are coupled in parallel with the string of BSY and red/orange LEDs 410A and C.

In operation, the control circuit 420 can affect operation of the additional LEDs 410B to increase the current drawn therethrough as the dimming input control increases. Therefore, as the current drawn through the serial connection of the BSY LEDs 410A and the red/orange LEDs 410C is reduced, the current drawn through the additional LEDs 410B can be increased to provide the additional v' component described above. In some embodiments according to the invention, the control circuit 420 can also be operatively coupled to a current source 905 which can also vary the amount of current provided to the additional LEDs 410B. Accordingly, the amount of light emitted by the additional LEDs 410B can be controlled both by a bypass circuit as described herein, as well as varying the current source 905. In some embodiments according to the invention, the current source 905 is provided without the use of a bypass circuit in association with the additional LEDs 410B.

Figure 10:
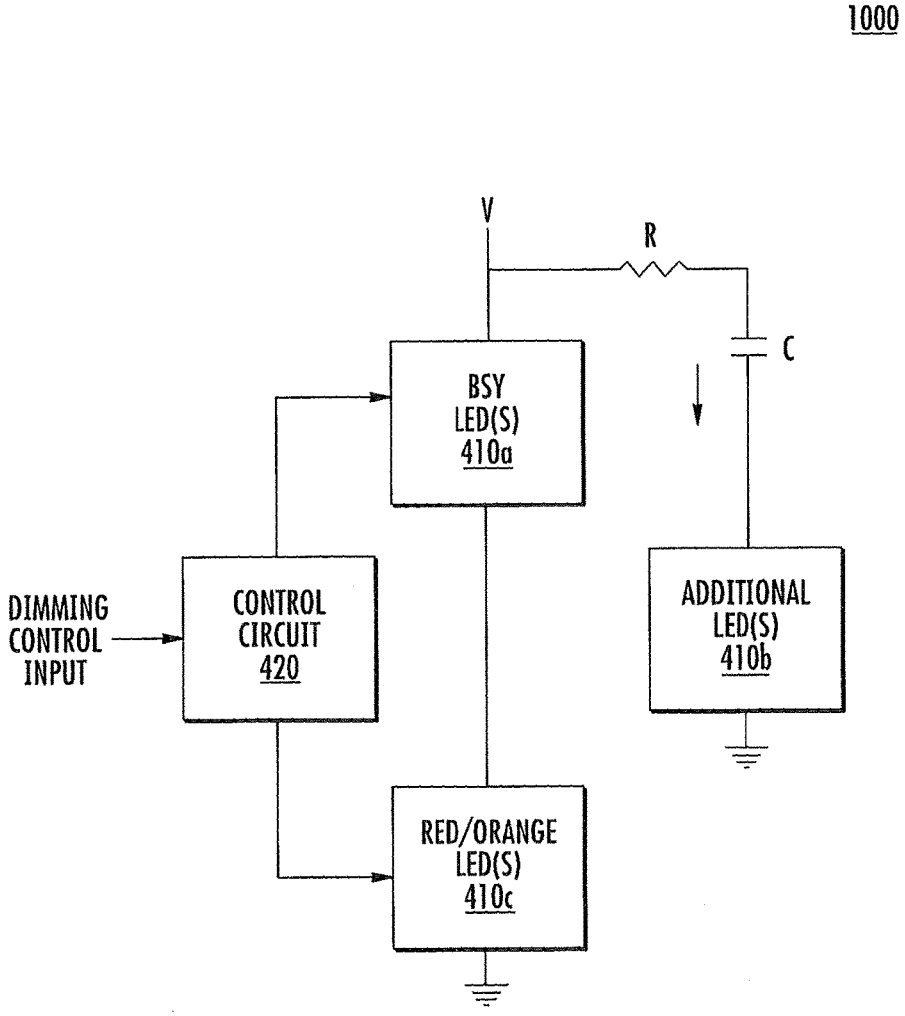
FIG. 10 is a block diagram illustrating a control circuit coupled to selective ones of the LEDs, coupled in parallel with a serial combination of an RC circuit and additional LEDs in some embodiments according to the invention.

FIG. 10 is a block diagram illustrating a lighting apparatus 1000 in some embodiments according to the invention. According to FIG. 10, the BSY LEDs 410A and the red/orange LEDs 410C are coupled in series with one another and are both operatively coupled to the control circuit 420 that operates in response to the dimming input. As further shown in FIG. 10, the additional LEDs 410B are coupled in series with an RC circuit both of which are coupled in parallel with the BSY LEDs 410A and the red/orange LEDs 410C. In operation, the RC circuit charges when the BSY LEDs 410A and the red/orange LEDs 410C are disabled by the control circuit 420. Periodically, the RC circuit will discharge to allow current to pass through the additional LEDs 410 thereby emitting light that provides the additional v' component described above in reference to FIG. 3. Specifically, in operation, the capacitor can be charged, which can be stored until dimming progresses, whereupon the charge can be released to provide the light from the additional LED(s), such as amber LED(s), to help provide the additional v' light component.

In further embodiments according to the present invention, the additional LEDs can be selected, as shown for example in FIG. 11, to provide an additional v' lighting component to shift the chromaticity of the combined light generated by the LEDs in the u'-y' space, that allows the light to more closely follow the Planckian locus over a wide range of dimming. For example, in some embodiments according to the invention, the lighting apparatus may already include a combination of blue-shifted-yellow LED(s) (B1) and red/orange LED(s) (R/O). The additional LED(s) B3, can add an additional v' component, for example, where the combination of the blue-shifted-yellow and red/orange LEDs would otherwise produce light having a chromaticity that is below the Planckian locus.

It will be understood that in some embodiments according to the invention, the additional v' component can be provided irrespective of dimming when, for example, during manufacturing, it is determined that (due to, for example, beyond specification variation in the distribution of the chromaticities of light emitted by the LEDs) the additional v' component is provided to bring the light output back within specification regardless of dimming. Furthermore, an estimation of the change in the chromaticity of the emitted light over time can be used to provide the additional v' component so that, over time, the additional v' component can be incorporated into the control of the control signals for the additional bypass circuit so as to compensate for the chromaticity change due to time.

As further shown in FIG. 11, in some embodiments according to the invention, the additional LEDs B3 can be situated in the X-Y chromaticity space to have a (ccy) component that is greater than the LEDs B2 so that a line segment 1105 drawn between the location of the additional LEDs B3 and the R/O LEDs encompasses at least the portion of the Planckian locus 300 over which a range of dimming is to be provided. For example, as shown in FIG. 11, a full range of dimming to a correlated color temperature (CCT) down to about 1800 K can be provided by selecting the additional LEDs B3 to have a (ccx, ccy) of about (0.42, 0.52) and is less than a saturated yellow chromaticity. In some embodiments, additional LEDs situated differently in the X-Y chromaticity space may be utilized to provide the additional v' component.

It will be further understood that, in some embodiments according to the invention, the LEDs B2 can provide the additional LEDs (i.e. be located lower in the chromaticity space than the LEDs B3). In such embodiments, it will be understood that the range of dimming provided by such an arrangement may be less than that described above where the additional LEDs B3 are used. For example, if the LEDs B2 provide the additional LEDs, a full range of dimming over the entire Planckian locus may not be provided. Instead, the compliance with the Planckian locus may terminate at a dimming level where a line connecting the LEDs B2 with the R/O LEDs intersects the Planckian locus. It will be further understood that the additional LEDs can occupy any point in the chromaticity space above the LEDs B1 with the understanding that the respective additional bypass circuit can be coupled across the additional LEDs to provide dimming in conformance with at least some portion of the Planckian. It will be further understood that in some embodiments according to the invention the range of dimming in conformance with Planckian locus may be limited due to the additional LEDs relationship with the R/O LEDs.

It will be further understood that the additional bypass circuit coupled across the additional LEDs can therefore be utilized to modulate light generated by the additional LEDs to provide the additional v' shift in the chromaticity space so that the light provided by the apparatus can conform more substantially to the Planckian locus over a wider range of dimming. Accordingly, whether the additional LEDs are provided by the LEDs B2 or the LEDs B3 (or other LEDs), the additional bypass circuit coupled across the respective additional LEDs, can be used to provide the additional v' shift to enable the light generated by the apparatus to stay on the Planckian locus over a wider range of dimming.

Although the term "chromaticity" is used herein to generally described the color characteristics of LEDs, other terms may also be used to refer to well known aspects of color characterization, such as Correlated Color Temperature (CCT). It will be further understood that any characterization of the color of LEDs can be used in conjunction with embodiments of the present invention.

FIG. 12 is a schematic diagram illustrating bypass circuits coupled across respective LEDs in further embodiments according to the invention. It will be understood that the configuration of LEDs shown in FIG. 12 can be provided in accordance with the block diagrams illustrated in, for example, FIGS. 4, 8 and 9, wherein, for example, the additional LEDs 1410*b* are situated in the X-Y chromaticity space as described above in reference to FIG. 11.

According to FIG. 12, the plurality of LEDs included in the lighting apparatus 1200 includes at least one BSY LED 1410A coupled in series with at least one red/orange LED 1410C which is coupled in series with at least one additional LED 1410B. The lighting apparatus 1200 also includes corresponding bypass circuits 1205-1215 (including Q11-Q13) coupled in parallel with each of the LEDs 1410A-C, respectively. It will be understood that the bypass circuit coupled across the at least one BSY LED 1410A, the at least one red/orange LED 1410C, and at least one additional LED 1410B can be utilized to effect the brightness level and/or CCT of the lighting apparatus 1200 in response to the input controls (dimming input and CCT input) provided to the control circuit 1120.

In operation, as the lighting apparatus 1200 is dimmed, the current provided to the string of LEDs is reduced which is monitored by the control circuit 1120 via the string current signal provided as a voltage across the resistor R. In response, the control circuit 1120 can modulate the bypass circuits 1205-1215 via respective control signals 1-3. For example, in some embodiments according to the invention, as the lighting apparatus 1200 is dimmed, the indication of the string current can be utilized by the control circuit 1120 to adjust the modulation of the bypass circuits 1205-1215 to provide the proper CCT for the lighting apparatus 1200 at the determined dimming level set by the string current. For example, as dimming is applied from a full on configuration where all LEDs are on, the modulation of bypass circuit 1205 can be adjusted via the control signal 1 so that current (over time) is bypassed around the BSY LEDs 1410A at a first rate.

While the modulation of the bypass circuit 1205 is being adjusted at the first rate, the control circuit 1120 also can adjust the modulation of the bypass circuit 1210 to control the amount of current bypassed around the additional LEDs 1410B at a second rate that is less than the first rate applied to the bypass circuit 1205 described above. Accordingly, the modulation of the bypass circuits 1205 and 1210 can be adjusted to maintain the CCT of the lighting apparatus 1200 on the Planckian locus 300 while the current provided to the apparatus 1200 is reduced in response to dimming. Still further, the modulation of the bypass circuit 1215 can also be adjusted by the control circuit 1120 in response to dimming by increasing the current through the R/O LEDs 1410C, particularly, when the dimming level is such that the CCT provided by the lighting apparatus 1200 is desired to be at a point on the Planckian locus 300 which is relatively close to a portion of the chromaticity space associated with the RIO LEDs 1410C.

It will be further understood that in some embodiments according to the invention, the additional LEDs 1410B can be situated in the X-Y chromaticity space to have a chromaticity coordinate that is less than that described above. For example, in some embodiments according to the invention, the CCX, CCY coordinates of the additional LEDs 1410B can be such that the CCX component is about 0.41 and the CCY component is equal to or less than about 0.5. It will be understood that in such configurations, the dimming range over which the lighting apparatus 1200 may operate at a CCT that is greater than that described above in reference to FIG. 12. For example, in some embodiments according to the invention where the additional LEDs 1410B are located lower in the chromaticity space (closer to the LEDs B2), the lower dimming range may terminate at a CCT that is greater than 1800K.

It will be understood that although FIG. 12 illustrates a single string with a particular LED configuration, other configurations of LEDs arranged a single string can also be used. For example, in some embodiments of the invention, the LED segments can include more than one LED in series. In some embodiments according to the invention, the LED segments can include a parallel arrangement of LEDs, such as to LEDs in parallel in the segment. In still other embodiments according to the invention, a combination of additional LEDs in series as well as additional LEDs in parallel with one another in the segments can also be used. It will also be understood that term "single string" includes arrangements of LEDs where, for example, the current used for dimming the light emitted by the lighting apparatus is provided to the same input of all the LEDs arranged in the string. Other arrangements may also be used.

In still further embodiments according to the invention, multiple strings of LEDs can be used where, for example, at least two of the modulated LED segments are include in a string and at least one additional modulated LED segment is included in another string.

In operation, the control circuit 1120 can operate the lighting apparatus 1200 as shown in FIG. 13. According to FIG. 13, during dimming the control circuit 1120 determines the current provided to the string based on the voltage across the resistor R shown in FIG. 12 (block 1305). The control circuit 1120 stabilizes the voltage provided across the resistor R and sets a flag to determine the modulation values provided to the bypass circuits 1205-1215 as the respective control signals once the voltage level across the resistor R has stabilized (block 1310). In some embodiments, the control circuit 1120 can stabilize the voltage level using a moving average filter. In some embodiments, the control circuit 1120 can stabilize the voltage level using a moving average filter including 32 past average values. Other approaches may also be used.

As described herein, in some embodiments according to the invention, the additional LEDs can be selected, as shown for example in FIG. 11, to provide an additional v' lighting component to shift the chromaticity of the combined light generated by the LEDs in the u'-v' space, that allows the light to more closely follow the Planckian locus over a wide range of dimming. For example, in some embodiments according to the invention, the lighting apparatus may already include a combination of blue-shifted-yellow LED(s) (B1) and red/orange LED(s) (R/O). The additional LED(s) B3, can add an additional v' component, for example, where the combination of the blue-shifted-yellow and red/orange LEDs would otherwise produce light having a chromaticity that is below the Planckian locus.

If the control circuit 1120 determines that the current in the string has changed since the voltage level was stabilized (block 1315), the control circuit 1120 again determines the string current based on the newly changed voltage across the resistor R (block 1305). In some embodiments, the control circuit 1120 determines that the current in the string has changed by determining if a particular number of previous samples of the voltage level is greater than a predetermined threshold.

The operational loop provided by the control circuit 1120 can continue until the control circuit 1120 determines that the current in the string is substantially unchanged (block 1315), whereupon the control circuit 1120 can then adjust the bypass circuits 1205-1215 from the currently applied modulation values for the respective bypass circuits 1205-1215 (block 1320). The operation shown in FIG. 13 can promote more stable conformance of the CCT on the Planckian locus by reducing a lag time between user dimming input and the adjustments to the CCT provided by the lighting apparatus by avoiding adjusting the bypass circuit's modulation until the dimming input has stabilized, whereupon the modulation control signals can then be applied. Accordingly, in such embodiments according to the invention, a closer adherence to the Planckian locus (or any other determined CCT curve in the chromaticity space) can be provided by the lighting apparatus 1200 using the additional LEDs situated in the chromaticity space described above.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device. Program code embodied on a computer readable signal medium may be transmitted using any appropriate medium, including but not limited to wireless, wireline, optical fiber cable, RF, etc., or any suitable combination of the foregoing.

Aspects of the present disclosure are described herein with reference to flowchart illustrations and/or block diagrams of methods, apparatus (systems), and computer program products according to embodiments of the disclosure. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable instruction execution apparatus, create a mechanism for implementing the functions/acts specified in the flowchart and/or block diagram block or blocks.

These computer program instructions may also be stored in a computer readable medium that when executed can direct a computer, other programmable data processing apparatus, or other devices to function in a particular manner, such that the instructions when stored in the computer readable medium produce an article of manufacture including instructions which when executed, cause a computer to implement the function/act specified in the flowchart and/or block diagram block or blocks. The computer program instructions may also be loaded onto a computer, other programmable instruction execution apparatus, or other devices to cause a series of operational steps to be performed on the computer, other programmable apparatuses or other devices to produce a computer implemented process such that the instructions which execute on the computer or other programmable apparatus provide processes for implementing the functions/acts specified in the flowchart and/or block diagram block or blocks.

In the drawings and specification, there have been disclosed typical preferred embodiments of the inventive subject matter and, although specific terms are employed, they are used in a generic and descriptive sense only and not for purposes of limitation, the scope of the inventive subject matter being set forth in the following claims.

What is claimed:

1. A solid state lighting apparatus including a plurality of light-emitting devices (LEDs) electrically coupled together in at least one string, the apparatus comprising:

a first LED segment in a first, string configured to emit a first chromaticity light, coupled across a first bypass circuit;

a second LED segment in the first string configured to emit a second chromaticity light, coupled across a second bypass circuit;

at least one additional LED segment configured to emit an additional chromaticity light, coupled across a respective at least one additional bypass circuit, wherein the first chromaticity light, the second chromaticity light, and the additional chromaticity light are all different respective chromaticities in a u'-v' chromaticity coordinate space; and a control circuit configured to control the at least one additional bypass circuit to cause the lighting apparatus to modify light emitted by the lighting apparatus to obtain an additional v' shift in a chromaticity value of the light emitted by the lighting apparatus so as to vary the light substantially in conformance with a Planckian locus in response to receiving a dimming input to the control circuit and determining that the dimming input would result in a combined CCT value of light emitted by the first LED segment and the second LED segment falling below 1800K, wherein a line segment drawn between a first chromaticity of a first light emitted by the at least one additional LED segment and a second chromaticity of a second light emitted by the second LED segment in an X-Y chromaticity space intersects the Planckian locus at a CCT value below 1800K.

2. The lighting apparatus of claim 1 wherein the first LED segment includes at least one Blue-Shifted Yellow (BSY) LED and the at least one additional LED segment includes at least one Blue-Shifted Yellow-Yellow (BSY-Y) LED.

3. The lighting apparatus of claim 1 wherein the additional chromaticity light comprises a predominant non-blue chromaticity.

4. The lighting apparatus of claim 1 wherein the control circuit is configured to control the first bypass circuit to reduce a current through the first LED segment at a first rate when dimming from full on and is configured to control the at least one additional bypass circuit to reduce a current through the at least one additional LED segment at a second rate when dimming from full on.

5. The lighting apparatus of claim 4 wherein the first rate is greater than the second rate.

6. The lighting apparatus of claim 1 wherein LEDs are absent from the at least one additional bypass circuit.

7. The lighting apparatus of claim 1 wherein the first LED segment includes three LEDs coupled in series; and wherein the at least one additional LED segment includes two LEDs coupled in series.

8. The lighting apparatus of claim 7 wherein the second LED segment includes two LEDs coupled in series.

9. The lighting apparatus of claim 1 wherein at least one LED in the at least one additional LED segment is included in the at least one additional bypass circuit.

10. A method of operating a dimmable solid state lighting apparatus including a plurality of light-emitting devices (LEDs) coupled together in a string including a first LED segment configured to emit a first chromaticity light, a second LED segment configured to emit a second chromaticity light, an additional LED segment configured to emit an additional chromaticity light, and a resistor, wherein the first chromaticity light, the second chromaticity light, and the additional chromaticity light are all different respective chromaticities in a u'-v' chromaticity coordinate space, the method comprising:

providing a dimming input to the lighting apparatus;

responsive to the dimming input, determining a first current value in the string based on a voltage across the resistor;

after determining the first current value, determining a second current value in the string based on the voltage across the resistor;

determining that the dimming input has stabilized responsive to a determination that the first current value and the second current value are unchanged; and responsive to determining that the dimming input has stabilized, providing modulation control signals to a bypass circuit across the additional LED segment, using a control circuit coupled to the string, to cause the lighting apparatus to modify light emitted by the lighting apparatus to obtain an additional v' shift in a chromaticity value of the light emitted by the string of the lighting apparatus so as to vary the light substantially in conformance with a Planckian locus in response to providing the dimming input corresponding to the chromaticity value of the light emitted prior to the modification being less than a predetermined correlated color temperature (CCT) value.

11. The method of claim 10 wherein controlling comprises controlling the first LED segment to reduce a current through the first LED segment at a first rate when dimming from full on; and controlling the additional LED segment to reduce a current through the additional LED segment at a second rate when dimming from full on.

12. The method of claim 11 wherein the first rate is greater than the second rate.

13. The method of claim 10 wherein the first LED segment includes at least one Blue-Shifted Yellow (BSY) LED and the additional LED segment includes at least one Blue-Shifted Yellow-Yellow (BSY-Y) LED.

14. The method of claim 10 further comprising:

controlling an additional bypass circuit coupled across the additional LED segment to provide the emitted light in conformance with the Planckian locus in response to providing the dimming input corresponding to the chromaticity value of the light emitted prior to the modification being less than or equal to about 1800K.

15. The method of claim 10 wherein the additional chromaticity light emitted by the additional LED segment comprises a predominant non-blue chromaticity.

16. A method of operating a dimmable solid state lighting apparatus including a plurality of light-emitting devices (LEDs) coupled together in a string including a first LED segment configured to emit a first chromaticity light coupled across a first bypass circuit, a second LED segment configured to emit a second chromaticity light coupled across a second bypass circuit, and an additional LED segment configured to emit an additional chromaticity light coupled across an additional bypass circuit, wherein the first chromaticity light, the second chromaticity light, and the additional chromaticity light are all different respective chromaticities in a u'-v' chromaticity coordinate space, the method comprising:

receiving a dimming input to adjust light emitted by the string;

determining a string current value indicating a current in the string developed responsive to the dimming input;

determining that the dimming input is stabilized responsive to a determination that the determined string current value is unchanged based on at least one prior string current value; and then providing modulation control signals to the additional bypass circuit across the additional LED segment, responsive to the determination that the dimming input is stabilized, to configure the string to modify light emitted by the lighting apparatus to obtain an additional v' shift in a chromaticity value of the light of the lighting apparatus so as to vary the light substantially in conformance with a Planckian locus in response to the dimming input, wherein a line segment drawn between the second chromaticity light and the additional chromaticity light in an X-Y chromaticity space intersects the Planckian locus at a correlated color temperature (CCT) value below 1800K, and wherein the providing of the modulation control signals to obtain the additional v' shift in the chromaticity value of the light of the lighting apparatus is performed only when a CCT of the light of the lighting apparatus falls below 1800K.

17. The method of claim 16 wherein the method further comprises:

maintaining present modulation control signals to the bypass circuits until determining that the dimming input is stabilized.

18. The method of claim 16 wherein determining that the dimming input is stabilized comprises applying a moving average filter to changing string current values indicating the string current.

19. The method of claim 18 wherein applying a moving average filter comprises applying a moving average filter using 32 past average string current values.

20. The method of claim 10 wherein determining the first current value in the string based on the voltage across the resistor comprises using a moving average filter including past average values of the voltage across the resistor.

21. The lighting apparatus of claim 1 wherein the first light emitted by the at least one additional LED segment is only emitted when a CCT value of the light emitted by the lighting apparatus falls below 1800K.

22. The method of claim 10 wherein a line segment drawn between the second chromaticity light and the additional chromaticity light in an X-Y chromaticity space intersects the Planckian locus at a CCT value below 1800K.

23. The method of claim 22 wherein the providing of the modulation control signals to the bypass circuit across the additional LED segment is performed only when a CCT of the light emitted by the lighting apparatus falls below 1800K.

* * * * *